US009707435B1

(12) United States Patent
Ferlito et al.

(10) Patent No.: US 9,707,435 B1
(45) Date of Patent: Jul. 18, 2017

(54) WEIGHT RESISTANCE APPARATUS

(71) Applicant: Maxxx-Force, Inc., Fort Lauderdale, FL (US)

(72) Inventors: John Ferlito, Fort Lauderdale, FL (US); Daniel Glenn, Davie, FL (US)

( * ) Notice: Subject to any disclaimer, the term of this patent is extended or adjusted under 35 U.S.C. 154(b) by 0 days.

(21) Appl. No.: 15/082,271

(22) Filed: Mar. 28, 2016

Related U.S. Application Data

(60) Provisional application No. 62/278,877, filed on Jan. 14, 2016.

(51) Int. Cl.

| | |
|---|---|
| ***A63B 24/00*** | (2006.01) |
| ***A63B 21/002*** | (2006.01) |
| ***A63B 21/00*** | (2006.01) |
| ***A63B 21/062*** | (2006.01) |
| ***A63B 23/12*** | (2006.01) |

(52) U.S. Cl.
CPC ..... *A63B 21/154* (2013.01); *A63B 21/063* (2015.10); *A63B 21/4035* (2015.10); *A63B 23/12* (2013.01); *A63B 24/0087* (2013.01)

(58) Field of Classification Search
CPC ... A63B 21/157; A63B 21/154; A63B 21/151; A63B 21/0615; A63B 21/063; A63B 21/28; A63B 21/285; A63B 21/00072; A63B 21/00076; A63B 21/002; A63B 21/0023; A63B 21/0783; A63B 21/062; A63B 21/0624; A63B 21/0626; A63B 21/0628; A63B 21/0632; A63B 21/15; A63B 21/0618
See application file for complete search history.

(56) References Cited

U.S. PATENT DOCUMENTS

| | | | | |
|---|---|---|---|---|
| 4,120,210 | A * | 10/1978 | Sloyan | F16M 7/00 248/657 |
| 4,200,279 | A | 4/1980 | Lambert, Jr. | |
| 4,787,630 | A | 11/1988 | Watson et al. | |
| 4,949,959 | A * | 8/1990 | Stevens | A63B 21/4029 482/104 |
| 5,344,374 | A | 9/1994 | Telle | |
| 5,407,403 | A * | 4/1995 | Coleman | A63B 21/078 482/104 |
| 5,435,798 | A * | 7/1995 | Habing | A63B 21/4047 482/5 |
| 5,447,484 | A | 9/1995 | Chandler | |
| 5,454,773 | A * | 10/1995 | Blanchard | A63B 24/00 482/133 |
| 5,823,921 | A * | 10/1998 | Dawson | A63B 21/078 482/104 |

(Continued)

OTHER PUBLICATIONS

U.S. Appl. No. 11/329,337, filed Jul. 26, 2007, Snyder.
U.S. Appl. No. 14/591,369, filed Jan. 7, 2015, Miller.

*Primary Examiner* — Loan H Thanh
*Assistant Examiner* — Nyca T Nguyen
(74) *Attorney, Agent, or Firm* — Jacqueline Tadros, Esq.; Jacqueline Tadros, P.A.

(57) ABSTRACT

A weight resistance apparatus including a threaded lead screw, a drive belt mechanically coupled with the lead screw, a lead screw that traverses a linear actuator carriage; at least one cable, and a cross bar member having at least one cavity and at least one aperture, whereby one end of the lead screw is secured within a first cavity and wherein the at least one cable extends through the at least one aperture.

24 Claims, 8 Drawing Sheets

(56) References Cited

U.S. PATENT DOCUMENTS 6,117,049 A * 9/2000 Lowe ..... A63B 21/0628 482/4
6,224,512 B1 * 5/2001 Arnesson ..... A63B 21/00181 482/5
6,368,251 B1 * 4/2002 Casler ..... A63B 21/005 482/4
6,646,431 B1 * 11/2003 Parvez ..... G01R 1/06705 324/750.22
6,852,046 B1 * 2/2005 Wewel ..... A63B 61/04 473/463
7,000,658 B1 * 2/2006 Soukiassian ..... B23D 45/027 144/114.1
7,341,546 B2 3/2008 Gautier
7,803,095 B1 9/2010 LaGree
8,388,504 B2 3/2013 Ellis
8,910,917 B1 * 12/2014 Bees ..... F16M 7/00 248/657
2004/0066552 A1 * 4/2004 Werba ..... G02B 21/26 359/391
2004/0254050 A1 * 12/2004 Morgan ..... A63B 21/00072 482/122
2005/0159278 A1 * 7/2005 McVay ..... A63B 21/068 482/142
2007/0054784 A1 * 3/2007 Wu ..... A47D 13/04 482/69
2010/0197462 A1 * 8/2010 Piane, Jr. ..... A61B 5/1113 482/5
2011/0237399 A1 * 9/2011 Toback ..... A63B 5/16 482/8
2013/0190143 A1 * 7/2013 Greenhill ..... A63B 21/0611 482/104
2014/0121071 A1 * 5/2014 Strom ..... A63B 21/062 482/99
2014/0213414 A1 * 7/2014 Balandis ..... A63B 24/0087 482/5
2014/0228175 A1 * 8/2014 Lemos ..... A63B 21/00076 482/5

* cited by examiner

WEIGHT RESISTANCE APPARATUS

CROSS-REFERENCE TO RELATED APPLICATIONS

This application claims the benefit U.S. provisional application No. 62/278,877 filed on Jan. 14, 2016, the disclosure of which is incorporated herein in its entirety by reference.

BACKGROUND OF THE INVENTION

1. Field of the Invention

The present disclosure relates generally to exercise machines. More particularly, the invention is directed to an improved weight resistance apparatus for assisting a trainer to generate a maximum positive force from a user.

2. Description of the Related Art

Enhancing performance via strength and conditioning training of muscles is the goal of many professional athletes and trainers as well as weekend warriors. It is known that there are three distinct phases in the movement of muscles and tendons, an eccentric contraction (extending the muscle), an isometric contraction (no movement), and a concentric contraction (contracting the muscle).

An eccentric contraction is the motion of an active muscle while it is lengthening under load. During an eccentric contraction, the muscles lengthen while producing force, usually by returning from a shortened (concentric) position to a resting position. Eccentric training focuses on slowing down the elongation of the muscle process in order to challenge the muscles, which can lead to stronger muscles, faster muscle repair and increasing metabolic rate. Eccentric training is particularly good for casual and high performance athletes or the elderly and patients looking to rehabilitate certain muscles and tendons.

An isometric contraction is a type of strength training in which the joint angle and muscle length do not change during contraction. Thus, isometrics occur in static positions, rather than being dynamic through a range of motion.

A concentric contraction occurs when the muscle shortens. Concentric contractions are the most common types of muscle activation athletes perform in a gym when lifting weights. Concentric contraction is also known as muscle shortening. Concentric contractions are common to many sports in which a subject needs to generate a lot of power or explosive force. Common exercises that cause concentric contractions include the lifting phase of a bicep curl, a squat or a pull up. Running up a hill or climbing stairs also causes the quadriceps to contract concentrically.

It is known that a subject's body can tolerate up to 1.75 times more weight eccentrically than it can concentrically. Thus, for example whereas a subject can exert approximately 500 pounds of force eccentrically, the same subject could only exert approximately 300 pounds concentrically. Therefore, when bench pressing a fixed weight of 300 pounds in a single load bearing movement using free weights as in a bench press, a subject will not be maximizing his or her eccentric load bearing force.

Maximizing eccentric load bearing training is the goal of adaptive stimulus and is ideal for maximizing strength, power and hypertrophy gains. The more intense eccentric training, that is, resisting weight as it comes down, the quicker and greater the results of achieving strength and conditioning training of muscles.

Free weights are excellent for increasing strength, however a distinct disadvantage of free weights is that they provide the same amount of resistance for the entire repetition and no resistance between repetitions. For example, after you perform the uplift on a bicep curl, there is no resistance during the pause.

Resistance training is effective in increasing eccentric force. It is known in the art to use bands and elastics to effect resistance training. For example, as you stretch an elastic band, it provides more resistance.

However, a disadvantage of elastics and exercise bands is that they do not provide as much resistance as heavy free weights and weight machines. Thus, resistance bands may not be a good choice for achieving strength-training goals.

Thus, it is desirable to have a device that will train the body using an effective resistance apparatus that also achieves strength training goals that allow the muscles to exert maximum concentric (pushing weight away from body), eccentric (resisting as it comes down) and isometric force throughout an entire load bearing exercise or repetition.

SUMMARY OF THE INVENTION

In accordance with the present invention, a weight resistance apparatus for an exercise device is disclosed. The present invention teaches the use of a resistance apparatus that will allow a subject to increase his or her force generating ability and potential, strength, power and speed. Thus the present invention allows a subject to exert maximum concentric, eccentric and isometric load throughout an entire repetition.

In one embodiment, the resistance apparatus includes a T shaped member. The T shaped member may be a single T shaped member or include a first member and a second member or cross bar, wherein the second member is substantially perpendicular to the first member and wherein the first member and second member are configured to form the shape of a T. The first member houses a linear actuator system comprising a lead or power screw and a linear actuator carriage. The linear actuator carriage further includes at least two vertical cable plates, a horizontal plate, a plurality of linear bearings secured to the underside of the horizontal plate and at least one acme nut.

The resistance apparatus further includes cable guide rails positioned on either side of the power screw, wherein each of the cable guide rails passes through the cable plates of the linear actuator carriage. Preferably, the cable guide rails are solid and rigid. They are also very smooth and hard to provide a smooth surface for the linear bearings to roll on. The linear bearings slide along the two cable guide rails and allow for smooth operation of the exercise apparatus. The linear bearings provide low friction the linear actuator carriage as the linear bearings use ball bearings as rolling elements. The cable guide rails ensure precise smooth travel movement of the linear actuator carriage.

The resistance apparatus further includes one or more cables, wire or rope that is secured to the linear actuator carriage. In a preferred embodiment, the cable attaches to a second vertical cable plate of the linear actuator carriage after having passed through first vertical cable plate. It is understood that a chain or other suitable substitute may also be used in place of a cable, wire or rope. In a preferred embodiment, the linear actuator carriage includes at least one load cell and a load plate. The load cell within the linear actuator carriage gauges the force applied by the user or trainee and transmits this information to an output device such as an LCD screen so a trainer or operator can assess the user's progress. A human machine interface, such as a touchscreen LCD may be included on a pedestal or tower for receiving information relating to the force applied by the user. In this embodiment, the one or more load cells are affixed to a load plate, such that as the cable is pulled in either direction, the load cell is forced against the linear actuator carriage thereby generating a force. Thus, if there is a load cell and load cell plate, the cables attach to the load cell plate and force the load cell plate against the carriage. The cables connect to the load cell plate adjacent to the load cells. The cables pass through the first and second vertical plates of the carriage between the linear bearings and the load cells and attach to the load cell plate.

The exercise apparatus further includes a tower or pedestal, a drive belt and mounted tensioner to control the timing belt. A lower timing gear is provided to secure the drive belt at a bottom point and an upper timing gear secures the drive belt at a top point. A right angle gear is positioned substantially adjacent to the lower drive gear. A shaft coupler links the lower timing gear, the right angle gear head and power screw. The drive belt may be a timing belt, mechanical belt or other suitable belt, as will be appreciated by one reasonably skilled in the art.

The exercise apparatus further includes at least two horizontal pulleys. A horizontal pulley is located on either side of the power screw and receives a cable, wire or rope. Each of the cables loops over each of the horizontal pulleys and is diverted in either direction to loop over a vertical pulley.

The cables emerging from the vertical pulleys may be attached to a handle, carabineer or loop within which a weight lifting bar or other device may be inserted for the trainee to grasp in order to allow the trainee to perform the resistance exercises.

In one embodiment, the pedestal or tower includes a crank handle in mechanical communication with the timing belt, such that as the crank handle is turned in a first direction, the power screw rotates in a first direction such that the rotation of the power screw moves the linear carriage system in a direction towards the cross bar. As the crank handle is turned in a second direction opposite the first direction, the power screw rotates in a second direction such that the rotation of the power screw moves the linear carriage system in a direction away from the cross bar and towards the pedestal or tower. Thus, the rotation of the timing belt and power screw and the movement of the linear actuator may be manually controlled by the crank handle.

It is to be noted that the present invention may be operated mechanically using a crank handle or alternatively, it may be operated via motor and/or electrical or electronic means. The operator or trainer and user or trainee work in cooperation in tandem, such that as the operator rotates the lead or power screw in a first direction, the linear actuator carriage is propelled towards the cross bar and the length of cable available to the user or trainee increases, allowing the user to undergo a concentric contraction, thereby contracting or shortening the muscle or muscles as the trainee pushes or pulls the bar or cables up via one or more handles. The muscles are shortened on a concentric phase. Conversely, as the operator rotates the lead screw in a second direction, opposite to the first direction, the rotation of the lead screw causes the linear actuator to move towards the pedestal, and the length of cable available to the user decreases, allowing the user to undergo an eccentric load contraction, thereby the muscle or muscles will be lengthening as the trainee attempts to push the bar or cables up via one or more handles. The trainee will not be able to overcome the resistance force as the linear actuator carriage is moved towards the pedestal and the bar will move downward despite the trainee's best efforts to resist the movement, as the trainee continues to push the bar up.

It is important to note that the trainee is always in resistance mode and is always attempting to "push or pull up" in a positive direction, regardless of whether the trainee is undergoing an eccentric, concentric or isometric contraction of the muscles. Thus, the trainer or operator controls the direction and movement and speed of the linear actuator carriage and cables. The operator controls the direction and length of cable and therefore the type of muscle contraction the trainee engages in, namely eccentric, concentric or isometric. The operator further controls the total time the trainee is under tension in a particular muscle contraction. For example, the operator may move the linear actuator carriage in a particular direction, thereby either increasing or decreasing the length of cable for a count of three and thereafter reverse direction for a count of two. The trainee however is always in resistance mode and is always attempting to "push or pull up" in the positive direction, in the case of a weight lifting bar or handle bars.

The operator has the power to customize the training program to a particular athlete by varying the direction, movement and/or speed of the linear actuator carriage and therefore the length of cable, as well as the total time under tension.

The trainee on his or her own is unable to rotate the lead or power screw and is therefore unable to propel the linear actuator carriage in any direction regardless of the force that is applied by the trainee to the cables. Thus, the trainee is under constant resistance from any direction of movement from the cables and is always attempting to "push or pull up" in the positive direction in the case of a weight lifting bar or one or more handles. The trainee however is dependent on the operator for determining whether the trainee will be undergoing a concentric, eccentric or isometric contraction, and is also dependent on the operator to determine the length of time the trainee exerts concentric, eccentric or isometric force. The operator may use manual or electronic means to control the movement of the lead screw and linear actuator carriage.

In a preferred embodiment, the timing belt and power screw and the movement of the linear actuator may be controlled via an electronic component. It is noted that the timing belt may be a drive belt or other suitable belt, as will be appreciated by one reasonably skilled in the art.

In yet another embodiment the present invention includes a load cell for measuring the force being applied by the user as the cables are drawn in towards the tower or let out towards the cross bar.

An object of the invention is that it allows a trainee to exert maximum concentric, eccentric and isometric force throughout an entire exercise cycle, thereby maximizing strength and conditioning training.

An advantage of the invention is that a trainee may exercise in relative safety, since there is little or no risk of injury to the trainee if the bar or handles are released and fall, since the actual weight of the bar is usually in the neighborhood of 30 to 45 pounds. This is in sharp contrast to the potential for serious injury to a trainee when lifting heavy weights upwards of two hundred pounds or more.

Another advantage of the invention is that it allows the operator to customize a protocol to a particular trainee to make sure the trainee is maximizing their training potential.

These and other aspects and advantages of the present disclosure will become apparent from the following detailed description of preferred embodiments of the invention considered in conjunction with the accompanying drawings, in which like drawings represent like components. It is to be understood, however, that the drawings are designed solely for purposes of illustration and not as a definition of the limits of the disclosure, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

FIG. 1 is a perspective view of the weight resistance apparatus of the present incorporating two load cells and a load cell plate.

DETAILED DESCRIPTION OF THE PREFERRED EMBODIMENTS

Figure 1:
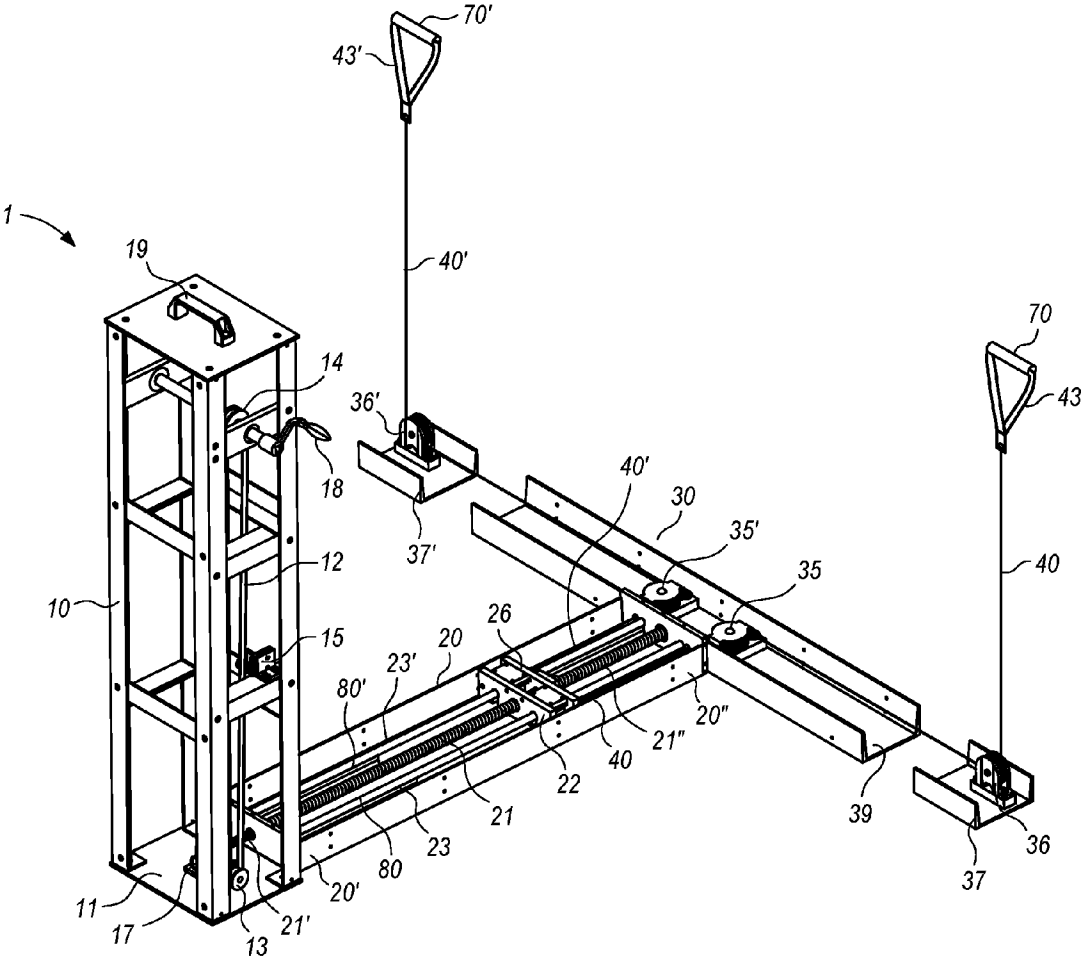
FIG. 1 is a perspective view of the weight resistance apparatus of the present invention using handle-bars.

Referring now to FIGS. 1-6B, there is shown a weight resistance apparatus 1 of the invention. The weight resistance apparatus 1 includes an upright tower 10, also referred to herein a pedestal 10, a first member 20 and a second member 30. The first member 20 is substantially perpendicular to the second member 30 and intersects the second member 30 at a relative midpoint of the second member 30, such that the combined first member 20 and second member 30 are configured to form a generally T-shape structure.

A first end 20' of the first member 20 is positioned proximate to a base 11 of the tower 10. A second end 20" of the first member 20 distal to the tower 10 intersects the second member 30 at a relative midpoint region of the second member 30.

The tower 10 houses a drive belt 12 that is secured at a first end to a lower gear drive 13 and at a second end to an upper gear drive 14. A tensioner 15 mounted on the drive belt 12 at a relative midpoint of the drive belt 12 provides control to counter any slack or looseness on the drive belt 12. The drive belt 12 is preferably a flexible toothed belt. In a preferred embodiment, the drive belt 12 is also a timing belt. The lower 13 and upper gear 14 apparatus may comprise a lower timing gear and an upper timing gear.

A coupling 16 links a gear drive 17 positioned proximate to the base 11 of the tower 10 to the lower gear drive 13. In a preferred embodiment, the gear drive 17 is a right angle gear head. The gear drive 17 may be a worm gear or another suitable gear, as will be appreciated by one reasonably skilled in the art.

In one embodiment a crank handle 18 is in mechanical communication with the upper gear drive 14 such that movement of the handle in a clockwise or counter clockwise direction will cause the drive belt 12 to rotate accordingly in a clockwise or counter clockwise direction. It is appreciated by one reasonably skilled in the art that the drive belt 12 may be activated via electronic means 90 as well as manually.

In one embodiment, a handle 19 is positioned on the tower 10 in order to allow an operator of the resistance apparatus 1 to lift, carry or move the apparatus 1. The handle 19 may also be used by an operator or to provide a convenient grip while manipulating the crank handle 18 or the apparatus 1. A motor 62 may be used to operate the invention.

The first member 20 houses a threaded lead screw 21, a linear actuator carriage 22 and cable guide rails 23 and 23'. The linear actuator carriage 22 includes two vertical cable plates 24 and 24', at least one horizontal plate 82 a plurality of linear bearings 25 and a threaded acme nut 26. Cable plate 24 is spaced at a relative distance from cable plate 24' and is separated from cable plate 24' via the at least one horizontal plate 82. The plurality of linear bearings 25 are secured to the underside of the at least one horizontal plate 82. Second cable plate 24 includes three apertures 27, 27' and 27" on its face. First cable plate 24' similarly includes three apertures 28, 28' and 28" on its face. Apertures 27, 27' and 27" are complementarily aligned with apertures 28, 28' and 28", such that the threaded lead screw 21 passes through apertures 27" and 28" and cable guide rails 23 passes through apertures 27 and 28, while cable guide rail 23' passes through apertures 27' and 28'. In a preferred embodiment, apertures 27" and 28" are threaded to engage and mate with the threading of the lead screw 21.

Cable guide rails 23 and 23' along either side of the lead screw 21. Cable guide rail 23 passes through apertures 27 and 28, while cable guide rail 23' passes through apertures 27' and 28'. Preferably, cable guide rails 23, 23' are solid and rigid. They are also very smooth and hard to provide a surface for the bearings to roll on. The linear bearings 25 slide along the guide rails 23, 23' and provide for smooth operation and provide low friction for the linear carriage 22 as the linear bearings 25 use ball bearings (not shown) as rolling elements. The guide rails 23, 23' ensure smooth travel of the linear actuator carriage 22.

The lead screw 21 extends along a length of the first member 20 and beyond the first member 20 to the tower 10 where a first end 21' of the lead screw 21 is in mechanical communication with the gear drive 17. Thus, the coupling 16 links the gear drive 17 and the lead screw 21 with the lower gear drive 13, such that when the drive belt 12 is activated in a first direction the lead screw 21 rotates in a first direction and when the drive belt is activated in a second direction, the lead screw rotates in a second direction, in reverse to the first direction.

In a preferred embodiment, the acme nut 26 is secured to the lead screw 21 on a side 29 of the first cable plate 24'. The acme nut 26 of the linear actuator carriage 22 is secured to the lead screw 21. Acme nut 26 converts the rotary motion of the lead screw 21 to linear motion. Thus, as the drive belt 12 is activated and the lead screw 21 rotates, the turning motion of the lead screw 21 translates into linear motion of the linear actuator carriage 22. The acme nut 26 converts the rotary motion of the lead screw 21 to linear motion such that the linear actuator carriage 22 moves in a linear direction along the length of the first member 20 either toward or away from the tower 10. It is appreciated that the linear actuator carriage 22 may be propelled to move towards the tower 10 or away from the tower 10 towards the second member 30 depending on the direction that the drive belt 12 is rotated.

The cable guide rails 23 and 23' are preferably solid and rigid. A first end 41 of cable 40 and a first end 41' of cable 40' is attached the linear actuator carriage 22. In one embodiment, the first end 41 of cable 40 is fixedly attached to cable plate 24' and the first end 41' of cable 40' is similarly fixedly attached to cable plate 24'. In another embodiment, the first end 41 of cable 40 passes through cable plate 24' and is fixedly attached to cable plate 24 and the first end 41' of cable 40' passes through cable plate 24' and is fixedly attached to cable plate 24. In yet another embodiment, the first end 41 of cable 40 is fixedly attached to cable plates 24 and 24' and the first end 41' of cable 40' is similarly fixedly attached to cable plates 24 and 24'.

In one embodiment, the second member 30 is fixedly attached to the first member 20. A second end 21" of the lead screw 21 is secured within a threaded aperture 31" positioned at a relative midpoint of cross bar member 81. Cable guide rails 23, 23' are positioned on either side of the lead screw. In one embodiment, cable guide rails 23, 23' are inserted within cavities 31 and 31' adjacent to 31". In another embodiment, cable guide rails 23, 23' are neither inserted in or pass through the cross bar member 81. Cable 40 passes through aperture 80, a first section of cable 40 loops around horizontal pulley 35 to generate a cable-pulley interaction. Similarly, cable 40' passes through aperture 80' and a first section of cable 40' loops around horizontal pulley 35' to generate a cable-pulley interaction. Cable 40 further extends and a second section of cable 40 loops over a vertical pulley 36 while cable 40' extends in an opposite direction and a second section of cable 40' loops over vertical pulley 36' to generate a cable-pulley interaction.

In a preferred embodiment, vertical pulleys 36 and 36' are housed in a third member 37 and a fourth member 37'. Third member 37 and fourth member 37' may be connected to a base 39 of the second member 30. Alternatively, the second member 30, third member 38 and fourth member 38' may share a common base 39. In yet another embodiment, the vertical pulleys 36 and 36' may be housed within the second member 30.

In a preferred embodiment, the weight resistance apparatus 1 includes the threaded lead screw 21, the drive belt 12 mechanically coupled with the first end of the lead screw 21, the linear actuator carriage 22 traversing the lead screw 21, the first cable 40 affixed to the linear actuator carriage 22 and an end plate or cross bar member 81 having a cavity 31' for receiving the second end of the lead screw 21". In one embodiment, the cross bar may include cavities 31 and 31" for receiving guide rails 23, 23' respectively. In another embodiment, the guide rails 23, 23' may be secured against the cross bar member 81 without actually penetrating or passing through the cross bar member 81. Cross member 81 further includes apertures 80, 80', and cables 40 and 40' extend through apertures 80 and 80' respectively and loop around horizontal pulleys 35, 35' and vertical pulleys' 36 and 36'.

In an embodiment, the weight resistance apparatus includes the threaded lead screw 21 having a first end 21' and a second end 21", the drive belt 12 coupled with the first end of the lead screw 21, the first guide rail 23 extends along the length of the lead screw 21. The second guide rail 23' is positioned at a distance from the first guide rail 23 and extends along the length of the lead screw 21 and a linear actuator carriage 22, wherein the lead screw 21 traverses the linear actuator carriage 22 and wherein a first end of the first cable 41 is affixed to the linear actuator carriage 22, a first end of the second cable 41' is affixed to the linear carriage 22, and wherein the first guide rail 23 and second guide rail 23' traverse the linear actuator carriage 22 and are positioned along a length of the lead screw 21, wherein the lead screw 21 is intermediate the first guide rail 23 and second guide rail 23' and is positioned therebetween.

In one embodiment, the linear actuator carriage 22 includes at least one load cell 92 and a load plate 94. The load cell 92 within the linear actuator carriage 22 gauges the force applied by the user or trainee and transmits this information to an output device such as an LCD 96 screen so a trainer or operator can assess the user's progress. The one or more load cells 92 is affixed to a load plate 94, such that as the cables 40, 40' is pulled in either direction, the load cell 92 is forced against the linear actuator carriage 22 thereby generating a measurable force.

A human machine interface, such as a touchscreen LCD 96 may be included on the pedestal or tower 10 for receiving information relating to the force applied by the user.

In one embodiment, the resistance apparatus 1 of the present invention is incorporated within an exercise device, such as a weight lifting rack 50. When the resistance apparatus 1 of the present invention is used in conjunction with a weight lifting rack 50 or other exercise device having a platform 52, it is preferable that the second member 30, third member 37 and fourth member 37' share a common base 39.

Cable 40 and 40' emerge from vertical pulleys 36 and 36'. Cable 40 connects to or forms a loop 43 as it emerges from vertical pulley 36. Similarly cable 40' connects to or forms a cable loop 43' as it emerges from vertical pulley 36'. A weight lifting bar 60 may be inserted within cable loops 43 and 43'. In one embodiment the cable loop may comprise a carabineer that includes one or more loop positions, 98, 98, 98" in which to insert a weight bar 60.

Thus, as a trainer manipulates the crank handle 18 to rotate the drive belt 12, the lead screw 21 rotates in a first direction and the linear actuator carriage 22 is propelled in a first direction thereby increasing the length of cable 43, 43' available to the user or trainee. As the trainee pushes or pulls upwards on the bar 60, the trainee will be able to concentrically contract his or her muscles because the length of the cable being let out is increasing.

Conversely, as the crank handle 18 is rotated in a second direction the drive belt 12 will cause the lead screw 21 to rotate in a second direction and the linear actuator carriage 22 will be propelled in a second direction, thereby decreasing the length of cable 43, 43' available to the user or trainee. Thus, as the trainee continues to push or pull upwards on the bar 60, the trainee muscle or muscles will undergo an eccentric load contraction as the length of the cable is drawn in and shortened thereby resulting in the bar 60 moving downward despite the upward resistance force RF exerted by the trainee or user.

Referring now in particular to FIG. 1, there is shown a perspective view of the weight resistance apparatus 1, including the upright tower 10, the first member 20 and the second member 30. The first member 20 is shown substantially perpendicular to the second member 30 and intersects the second member 30 at a relative midpoint of the second member 30, such that the combined first member 20 and second member 30 are configured to form a generally T-shape structure. The first end 20' of the first member 20 is positioned proximate to the base 11 of the tower 10. The second end 20" of the first member 20 distal to the tower 10 intersects the second member 30 at a relative midpoint region of the second member 30.

The drive belt 12 is positioned within the tower 10. A first end of the drive belt 12 is positioned around the lower gear drive 13 and a second end of the drive belt 12 is positioned around the upper gear drive 14. The tensioner 15 is mounted on the drive belt 12 at a relative midpoint of the drive belt 12. The right angle gear head 17 positioned proximate to the base 11 of the tower 10 to the lower gear drive 13.

The crank handle 18 is shown in mechanical communication with the upper gear drive 14. The first member 20 houses the threaded lead screw 21, the linear actuator carriage 22 and the cable guide rails 23 and 23'. The linear actuator carriage 22 includes threaded acme nut 26. Cable guide rails 23 and 23' are housed within the first member 20 along either side of the lead screw 21.

The cable guide rails 23 and 23' extends along the length of the lead screw 21, with the lead screw positioned therebetween. The cable guide rails 23, 23' pass through the linear actuator carriage 22 The first end 41 of cable 40 and a first end 41' of cable 40' is attached the linear actuator carriage 22.

The second member 30 is fixedly attached to the first member 20. Cable 40 loops around horizontal pulley 35 to generate a cable-pulley interaction. Similarly, cable 40' passes around horizontal pulley 35' to generate a cable-pulley interaction. Cable 40 further extends and loops over a vertical pulley 36 which is affixed to the third member 37, while cable 40' extends in an opposite direction and loops over vertical pulley 36' which is affixed to the fourth member 37', to generate a cable-pulley interaction. Cables 40 and 40' connect to or form loops 43 and 43'. Handles 70 and 70' are attached to cable loops 43 and 43' respectively.

Figure 2:
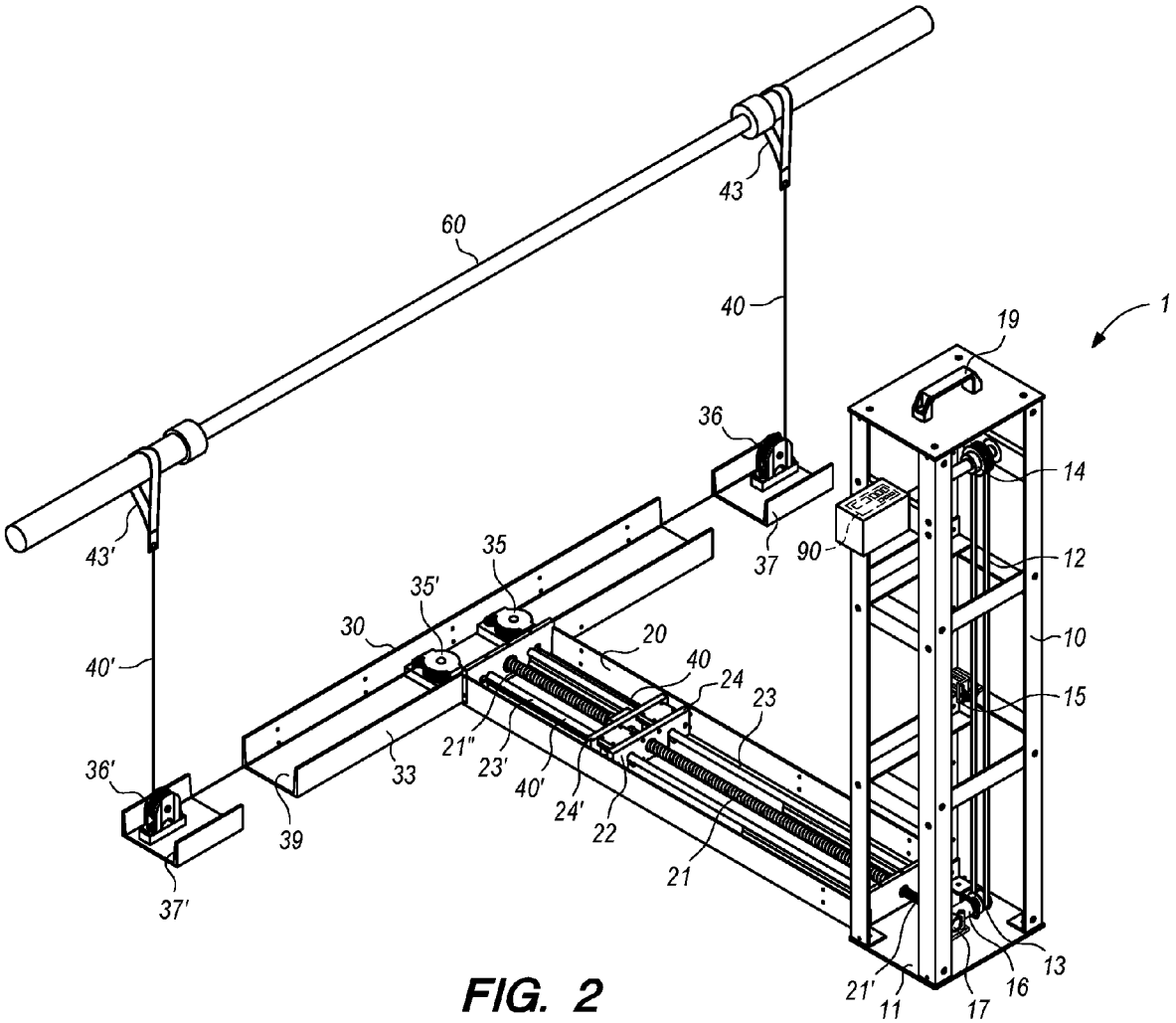
FIG. 2 is a perspective view of the weight resistance apparatus of the present invention with a weight lifting bar.

FIG. 2 is a perspective view of the weight resistance apparatus 1 with a weight lifting bar 60 passing through cable loops 43 and 43'. The coupling 16 links the right gear head 17 to the lower gear drive 13. The lead screw 21 extends along a length of the first member 20 and beyond the first member 20 to the tower 10 where a first end 21' of the lead screw 21 is in mechanical communication with the gear drive 17. Thus, the coupling 16 links the gear drive 17 and the lead screw 21 with the lower gear drive 13, such that when the drive belt 12 is activated in a first direction the lead screw 21 rotates in a first direction and when the drive belt is activated in a second direction, the lead screw rotates in a second direction, in reverse to the first direction. In this embodiment of the invention the drive belt 12 is manipulated via electronic means 90.

Figure 3:
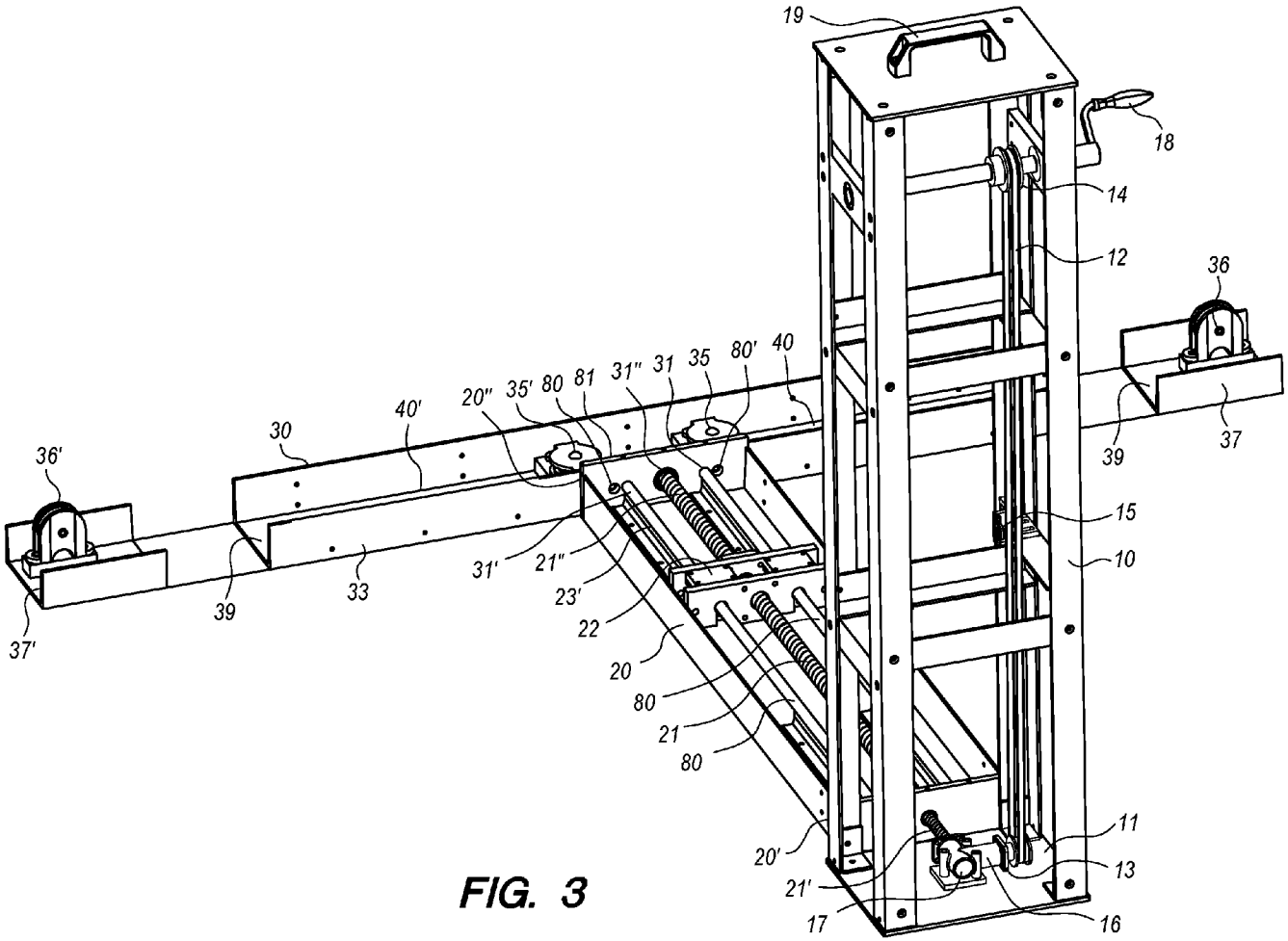
FIG. 3 is a perspective view of the weight resistance apparatus of the present invention without the cables.

FIG. 3 illustrates a perspective view of the weight resistance apparatus 1 without the cables 40 and 40' shown. The second end 21" of the lead screw 21 is secured within the threaded aperture 31". Cable 40 passes through aperture 80 and loops around horizontal pulley 35 and cable 40' passes through aperture 80' and loops around horizontal pulley 35'.

Figure 4A:
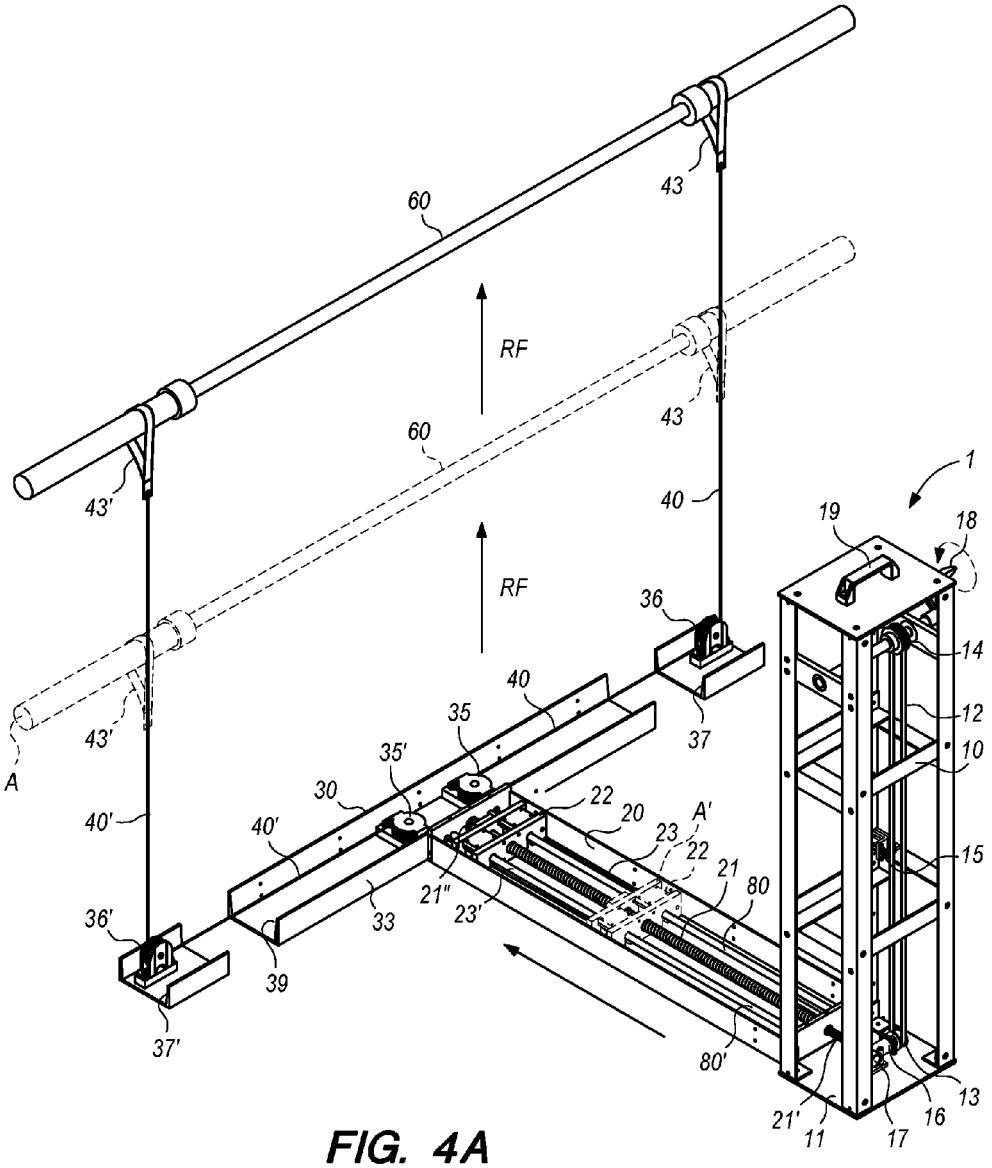
FIG. 4A is a perspective view of the weight resistance apparatus of the present invention while in use and illustrates the bar moving upward as it is subjected to an upward resistance force and shows movement of the linear actuator carriage as the drive belt is activated and the lead screw rotates in a first direction.

Referring now to FIG. 4A there is shown a perspective view of the weight resistance apparatus 1 while in use and illustrates the 60 bar moving upward as it is subjected to an upward resistance force RF and shows movement of the linear actuator carriage 22 as the drive belt 12 is activated via a rotation of the crank handle 18 causing the lead screw 22 to rotate in a first direction. Thus, as a trainer manipulates the crank handle 18 to rotate the drive belt 12, the lead screw 21 rotates in a first direction and the linear actuator carriage 22 is propelled in a first direction thereby increasing the length of cable 43, 43' available to the user or trainee. As the trainee pushes or pulls the bar 60 upwards from its initial position "A", the force applied to the bar 60 by the trainee RF will allow the trainee muscle or muscles to undergo a concentric contraction because the length of the cable 43, 43' being let out is increasing. In this embodiment, third member 37 and fourth member 37' share base 39 of the second member 30.

Figure 4B:
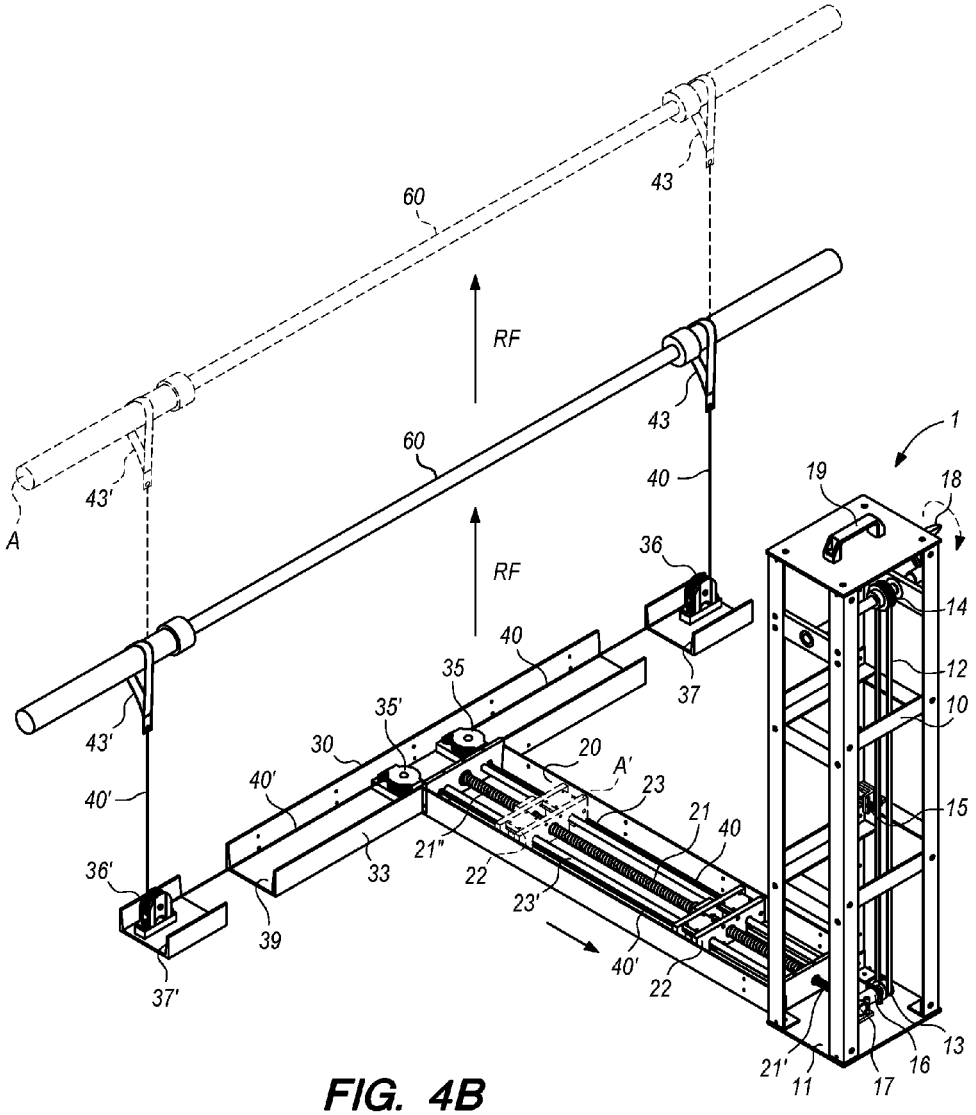
FIG. 4B is a perspective view of the weight resistance apparatus of the present invention while in use and illustrates the bar moving downward even as it is being subjected to an upward resistance force and shows movement of the linear actuator carriage as the drive belt is activated and the lead screw rotates in a second direction that is the reverse of the first direction as shown in FIG. 4A.

Referring to FIG. 4B there is shown a perspective view of the weight resistance apparatus 1 that illustrates the bar 60 moving downward even as it is being subjected to an upward resistance force RF and shows movement of the linear actuator carriage 22 as the drive belt 12 is activated via rotation of the crank handle 18 causing the lead screw 21 to rotate in a second direction that is the reverse of the first direction shown in FIG. 4A. Thus, as the trainee continues to push or pull upwards on the bar 60, the trainee will be compelled to contract his or her muscles as the length of the cable 43, 43' is drawn in and shortened thereby resulting in the bar 60 moving downward despite the upward resistance force RF exerted by the trainee or user. Thus, as the trainee continues to exert an upward resistance force RF on the bar 60, the trainee muscle or muscles will undergo an eccentric contraction as the length of the cable is drawn in and shortened thereby resulting in the bar 60 moving downward from its initial position "A" despite the upward resistance force RF exerted by the trainee or user.

Figure 5A:
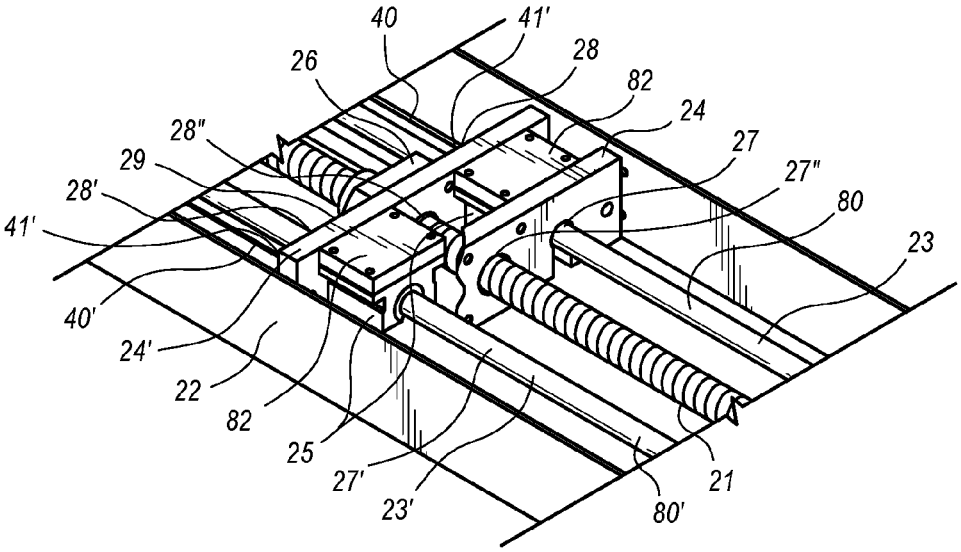
FIG. 5A is a close up view of the power screw and linear actuator carriage system of the weight resistance apparatus.

FIG. 5A is a close up view of the power screw 21 and linear actuator carriage system 22 of the weight resistance apparatus 1. The linear actuator carriage 22 includes cable plates 24 and 24', the linear bearings 25 and the threaded acme nut 26. Cable plate 24 is spaced at a relative distance from cable plate 24' via horizontal plates 82. Linear bearings 25 are secured to the underside of the horizontal plates 82 that maintain cable plate 24 at a distance from cable plate 24'. Cable plate 24 includes three apertures 27, 27' and 27" on its face. Cable plate 24' similarly includes three apertures 28, 28' and 28" on its face. Apertures 27, 27' and 27" are complementarily aligned with apertures 28, 28' and 28", such that the threaded lead screw 21 passes through apertures 27" and 28" and cable guide rails 23 passes through apertures 27 and 28, while cable guide rail 23' passes through apertures 27' and 28'. In a preferred embodiment, apertures 2T' and 28" are threaded to engage and mate with the threading of the lead screw 21.

In this embodiment, the acme nut 26 is secured to the lead screw 21 on the side 29 of the cable plate 24' facing towards the second member 30. The acme nut 26 of the linear actuator carriage 22 is secured to the lead screw 21.

A first end 41 of cable 40 and a first end 41' of cable 40' is attached the linear actuator carriage 22. In one embodiment, the first end 41 of cable 40 is fixedly attached to cable plate 24' and the first end 41' of cable 40' is similarly fixedly attached to cable plate 24'. In another embodiment, the first end 41 of cable 40 is fixedly attached to cable plate 24 and the first end 41' of cable 40' is similarly fixedly attached to cable plate 24. In yet another embodiment, the first end 41 of cable 40 is fixedly attached to cable plates 24 and 24' and the first end 41' of cable 40' is similarly fixedly attached to cable plates 24 and 24'.

Figure 5B:
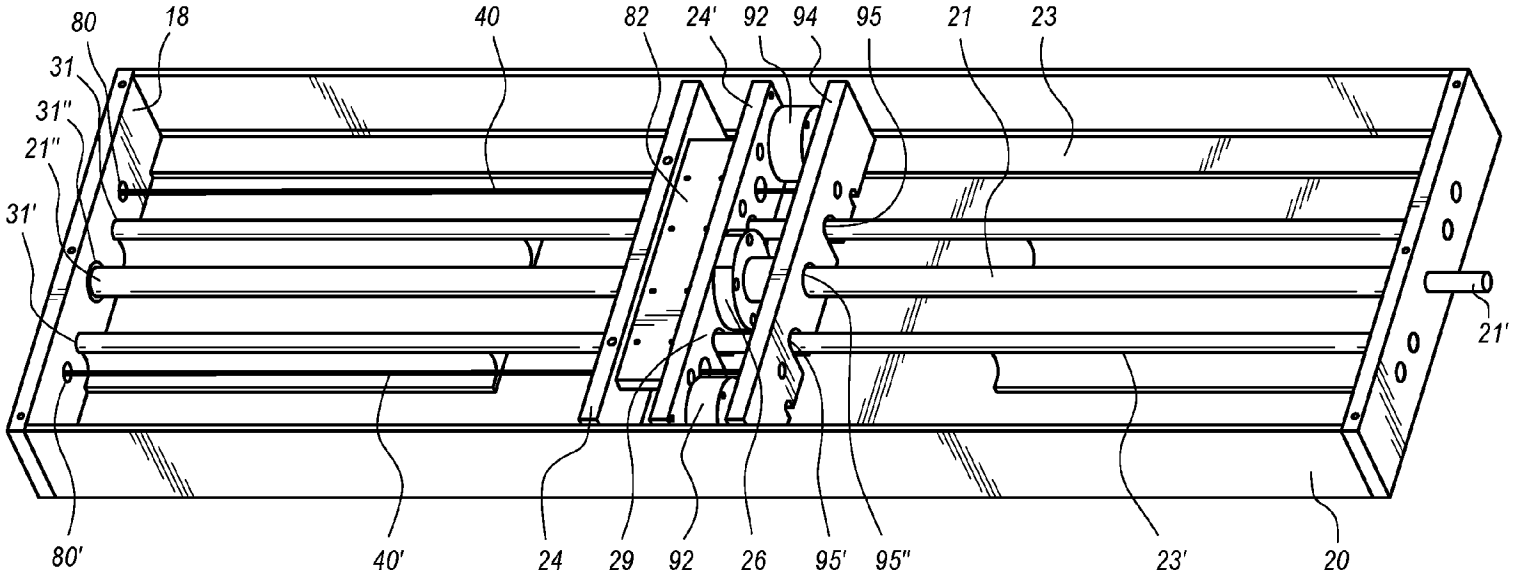
FIG. 5B is a perspective view of the power screw and linear actuator carriage system

FIG. 5B is a perspective view of the power screw 21 and linear actuator carriage system 22 incorporating two load cells 92 and a load cell plate 94. Apertures 95, 95', 95" are complementarily aligned with apertures 27, 27' and 27" and with apertures 28, 28' and 28", such that the threaded lead screw 21 passes through apertures 27", 28" and 95" and cable guide rails 23 passes through apertures 27, 28 and 95, while cable guide rail 23' passes through apertures 27', 28' and 95'. In a preferred embodiment, apertures 2T', 28" and 95" are threaded to engage and mate with the threading of the lead screw 21.

In this embodiment, the linear actuator carriage 22 includes two vertical cable plates 24, 24' separated by a horizontal plate 82 at the top. The linear bearings 25 (not shown) are secured to the underside of the horizontal plate 82. The linear bearings 25 slide along the two guide rails 23, 23'. They allow for smooth operation and provide low friction the linear actuator carriage 22 as the linear bearings 25 use ball bearings as rolling elements. The guide rails 23, 23' ensure precise smooth travel of the linear actuator carriage 22. The cables 40, 40' connect to the load cell plate 94 adjacent to the load cells 92. The cables 40, 40' pass through the vertical cable plates 24, 24' of the linear actuator carriage 22 between the linear bearings 25 (not shown) and the load cells 92.

The load cells 92 within the linear actuator carriage 22 gauge the force applied by the user or trainee and transmits this information to an output device such as an LCD screen 96. A human machine interface, such as a touchscreen LCD 96 may be included on the tower 10 for receiving information relating to the force applied by the user. In this embodiment, the cables 40, 40' are affixed to the load cell plate 94. The load cells 92 are affixed to the load cell plate 94, such that as the cables 40, 40' are pulled in either direction, the load cells 92 are forced against the cable plate 24' of the linear actuator carriage 22 thereby generating a force to be measured by the load cell 92.

Figure 6A:
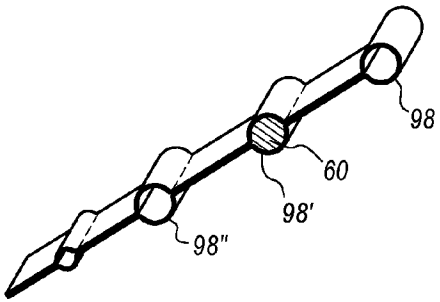
FIG. 6A is a perspective view of the weight resistance apparatus incorporated into a weight lifting rack.

FIG. 6A is a perspective view of the weight resistance apparatus 1 incorporated into a weight lifting rack 50 having a platform 52.

Figure 6B:
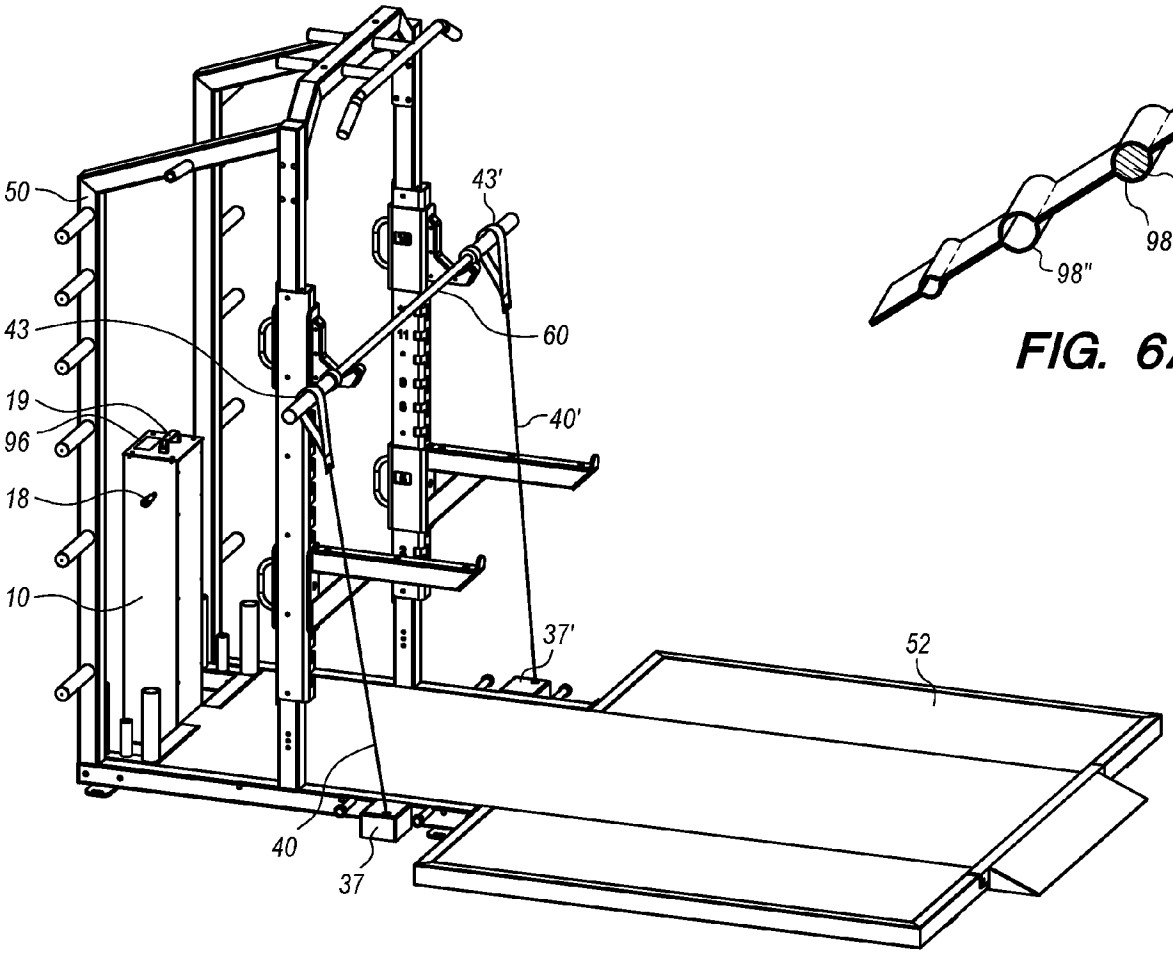
FIG. 6B is a perspective view of an alternative embodiment of a cable loop illustrating a carabineer loop showing a portion of a weight lifting bar in three possible positions.

FIG. 6B is a perspective view of an alternative embodiment of a cable loop illustrating a carabineer loop with a weight lifting bar 60 in three possible positions 98, 98', 98". There is shown a series a three weight bar loops 98, 98', 98" representing three possible positions in which to insert a weight bar 60 or handles 70, 70'. Thus, the effective length of the cable 40, 40' may be altered by selecting one of the three possible positions 98, 98', 98" in which to insert the weight bar 60 or handles 70, 70'.

Thus, while there has been shown and described, fundamental novel features of the disclosure as applied to various specific embodiments thereof, it will be understood that various omissions and substitutions and changes in the form and details of the apparatus illustrated, and in their operation, may be made by those skilled in the art without departing from the spirit of the disclosure. For example, it is expressly intended that all combinations of those elements and/or method steps which perform substantially the same function, in substantially the same way, to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore to be limited only as indicated by the scope of the claims appended hereto.

What is claimed is:

1. A weight resistance exercise apparatus comprising:

a threaded lead screw including a first end and a second end;

a linear actuator carriage, wherein the lead screw traverses the linear actuator carriage, and wherein the linear actuator carriage includes a first vertical cable plate and a second vertical cable plate at a spaced distance from the first vertical cable plate, a horizontal plate positioned between the first and second cable plates and linear bearings positioned on an underside of the horizontal plate, such that the linear bearings are similarly positioned between the first and second plates and an acme nut secured to the lead screw and positioned adjacent the second vertical cable plate, on a side of the second vertical cable plate facing a member having a plurality of apertures;

a plurality of cables, wherein a first end of a first cable of the plurality of cables is affixed to the linear actuator carriage and wherein a first end of a second cable of the plurality of cables is affixed to the linear actuator carriage at a distance from the first cable, such that the lead screw is positioned intermediate and therebetween the first and second cable; and wherein the first cable extends through a first aperture of the plurality of apertures of the member and the second cable extends through a second aperture of the plurality of apertures of the member.

2. The weight resistance exercise apparatus of claim 1, further including a right angle gear head.

3. The weight resistance exercise apparatus of claim 2, wherein a coupling links the lead screw and the right angle gear head.

4. The weight resistance apparatus of claim 3, wherein the direction and movement of the lead screw is controlled via a motor.

5. The weight resistance exercise apparatus of claim 4, wherein activation of the motor, causes the lead screw to rotate in a first direction and the acme nut to convert the rotary motion of the lead screw to linear motion such that the linear actuator carriage and the first cable move in a first linear direction.

6. The weight resistance exercise apparatus of claim 5, wherein activation of the motor causes the lead screw to rotate in a second direction opposite to the first direction and the acme nut to convert the rotary motion of the lead screw to linear motion such that the linear actuator carriage and the first cable move in a second linear direction, opposite the first linear direction.

7. The weight resistance apparatus of claim 2, further including a drive belt wherein the drive belt is mechanically coupled with a crank handle, such that the handle exerts manual control over the direction and movement of the drive belt.

8. The weight resistance exercise apparatus of claim 1, further including a sensor for gauging the force applied by a user as the linear actuator carriage is set in motion.

9. The weight resistance exercise apparatus of claim 8, wherein the sensor transmits data regarding the force applied by the user to an output device.

10. The weight resistance exercise apparatus of claim 9, wherein the output device is a machine configured for human interface.

11. The weight resistance exercise apparatus of claim 8, wherein the sensor is a load cell.

12. The weight resistance exercise apparatus of claim 11, wherein the load cell is affixed to a load cell plate.

13. The weight resistance exercise apparatus of claim 8, wherein the sensor is in mechanical communication with the linear actuator carriage.

14. The weight resistance exercise apparatus of claim 1, wherein a first section of the at least one cable engages a first pulley and a second section of the of the first cables engages a second pulley, to generate a cable pulley interaction and whereby the second pulley is located at a distance from the first pulley.

15. The weight resistance exercise apparatus of claim 14, wherein a first section of the second cable engages a third pulley and a second section of the second cable engages a fourth pulley, to generate a cable pulley interaction and whereby the third pulley is located at a distance from the fourth pulley.

16. The weight resistance exercise apparatus of claim 15, wherein the first cable is engaged with the first and second pulley and is guided in a first direction and the second cable is engaged with the third and fourth pulley and is guided in a second direction opposite the first direction, and wherein the first, second, third and fourth pulleys are generally horizontally aligned.

17. The weight resistance exercise apparatus of claim 16, wherein a second end of the second cable includes a loop for receiving a handle or weight lifting bar.

18. The weight resistance exercise apparatus of claim 14, wherein the member separates the linear actuator carriage from each of the first pulley and the second pulley, such that the linear actuator carriage is positioned on a first side of the member and the first pulley and the second pulley are positioned on a second and opposite side of the member.

19. The weight resistance exercise apparatus of claim 1, further including a generally T-shaped member, the T-shaped member including a first member and a second member, wherein the second member is generally perpendicular to the first member and adjoins the first member at a relative midpoint region of the first member, such that the first and second member form the generally T-shaped member.

20. The weight resistance exercise apparatus of claim 19, wherein the T-shaped member is a unitary structure.

21. The weight resistance exercise apparatus of claim 19, wherein the T-shaped member comprises a plurality of members.

22. The weight resistance exercise apparatus of claim 1, further including an LCD touchscreen.

23. The weight resistance exercise apparatus of claim 1, wherein a second end of the first cable includes a loop for receiving a handle or weight lifting bar.

24. The weight resistance exercise apparatus of claim 1, wherein the first vertical cable plate includes a first threaded hole complementarily aligned with a second threaded hole of the second vertical cable plate, such that the lead screw intersects the first and second threaded holes of the first and second plates of the linear actuator carriage.

* * * * *